US009412243B2

(12) United States Patent
Hamilton

(10) Patent No.: US 9,412,243 B2
(45) Date of Patent: Aug. 9, 2016

(54) PORTABLE SECURITY SYSTEM

(71) Applicant: Christopher C Hamilton, New Orleans, LA (US)

(72) Inventor: Christopher C Hamilton, New Orleans, LA (US)

( * ) Notice: Subject to any disclaimer, the term of this patent is extended or adjusted under 35 U.S.C. 154(b) by 0 days.

(21) Appl. No.: 14/011,507

(22) Filed: Aug. 27, 2013

(65) Prior Publication Data

US 2015/0061870 A1 Mar. 5, 2015

(51) Int. Cl.
*G08B 13/14* (2006.01)
*G08B 13/12* (2006.01)

(52) U.S. Cl.
CPC ..... *G08B 13/122* (2013.01)

(58) Field of Classification Search
CPC ..... G08B 25/10; G08B 25/008; G08B 25/08; G08B 13/00; G08B 13/1427; G08B 19/00; G08B 21/0275; G08B 7/06
USPC ..... 340/568.1, 541, 545, 546, 564, 500, 340/539.1, 545.3; 379/39
See application file for complete search history.

(56) References Cited

U.S. PATENT DOCUMENTS 4,136,338 A * 1/1979 Antenore ..... 340/551
5,117,223 A 5/1992 Tanner
5,463,595 A * 10/1995 Rodhall et al. ..... 367/93
5,767,771 A * 6/1998 Lamont ..... 340/571
6,118,375 A 9/2000 Duncan
6,181,244 B1 1/2001 Hall et al.
6,441,731 B1 8/2002 Hess
6,720,881 B1 * 4/2004 Halliday ..... 340/573.4
6,774,790 B1 * 8/2004 Houston ..... 340/556
6,864,789 B2 * 3/2005 Wolfe ..... 340/539.1
7,301,457 B2 * 11/2007 Houston ..... 340/556
7,782,199 B2 8/2010 Issokson
7,961,088 B2 * 6/2011 Watts et al. ..... 340/506
8,193,936 B2 * 6/2012 Houston ..... 340/556
2005/0012591 A1 * 1/2005 Tomljenovic et al. ..... 340/5.31
2007/0222588 A1 9/2007 Wolfe
2007/0252720 A1 11/2007 Hughes et al.
2008/0169922 A1 7/2008 Issokson
2009/0009326 A1 * 1/2009 Veiga, III ..... 340/541
2009/0207014 A1 * 8/2009 Ayed ..... 340/539.13
2009/0289790 A1 * 11/2009 Issokson ..... 340/552

* cited by examiner

*Primary Examiner* — Eric M Blount
(74) *Attorney, Agent, or Firm* — Keaty Law Firm, LLC

(57) ABSTRACT

A portable alarm system designed for unoccupied unsecured locations, such as construction sites, machinery, campsites and the like. The alarm system defines a continuous monitoring line about the perimeter of the unsecured location using a plurality of wireless sensors attached to a flexible non-stretchable tape suspended between to vertical poles. The system has motion-sensing/detecting capabilities such that any movement of a housing where the microprocessor of the system is located generates audible/visual alarm. Each of the wireless sensors has a magnet and a transmitter positionable within a predetermined distance from the magnet. If the intruder tampers with the tape and increases the distance between the magnet the transmitter, the alarm is activated as well.

18 Claims, 3 Drawing Sheets

PORTABLE SECURITY SYSTEM

BACKGROUND OF THE INVENTION

The invention relates to monitoring and alarm systems, and more particularly, to a wireless security alarm system designed specifically for portability and ease of installation. Even more particularly, the present invention relates to a wireless security system adapted for use at unsecured locations, such as construction site, in combination with pieces of valuable equipment, tool chests and the like.

There are many types of monitoring and alarm systems currently available to consumers. However, none effectively secure construction sites from criminal activity and these areas are often hotbeds for criminal activity. According to the 2012 National Insurance Crime Bureau Report, the estimated cost of stolen heavy equipment in the United States is between $300 million and $1 billion annually. Because construction sites are often left unsecured and because of the nature of the ongoing work, tools, heavy equipment, and building materials are at risk of being stolen if not afforded high security measures. Additionally, these sites are commonly targets for acts of arson and vandalism. Prior art devices do not adequately provide secure systems which are wireless, portable and self-contained with the ability to secure the entire perimeter of a remote unoccupied location.

Some known solutions to the problem can be seen in, for instance U.S. Pat. No. 7,782,199. The '199 patent teaches a portable self-contained alarm system transportable to remote locations for securing the location against theft or other intrusions. The system has a sealed container weighted at the bottom for stability and securable to a mounting pole. The system of the '199 patent has a variety of sensing equipment to detect and visually record intruders and notify a remote location of the intrusion. Cameras and a digital video recorder could be added to create a mobile video device. A control panel having a keypad is attached to an exterior of the mobile container, the control panel communicating with the electronic control circuit to control the electronic circuit and a series of control panel security devices electrically communicating with the electronic control circuit. A variety of security and recording devices are mounted on the mounting pole for 360 degree visual monitoring and recording and transmission to a remote monitoring station.

Another example of a construction site portable monitoring system is disclosed in U.S. Pat. No. 6,181,244. The system of the '244 patent includes a housing, a plurality of portable sensing devices and a plurality of mounting platforms both capable of being removably stored in the housing. The mounting platforms may be easily retrieved from the housing and disposed about the site and are each capable of detachably mounting one or more of the portable sensing devices. The housing further includes a communication system for receiving the transmitted signals from each of the portable sensing devices and communicating signals associated with the sensed intrusion to a monitoring station.

Still another example of a portable alarm system is disclosed in U.S. Pat. No. 6,118,375. The '375 patent teaches the use of a plurality of infrared motion detection modules, each being provided with a lightweight support, a solar panel charging device, and an alarm signal. The lightweight support allows the motion detection module to be disposed at a height sufficient to detect motion over a very wide area or volume of space. The portable intruder detection system of the '375 patent has a 360-degree motion sensor and a hardwired or RF remote arm/disarm and notification system. The motion sensor is mounted on a lightweight fiberglass or composite material telescopic pole that positions the sensor from six to twelve feet in the air when fully extended. The telescopic pole has a lightweight tripod attached at the base for stabilization. The sensor is further stabilized by strings, which run from the base of the sensor to stakes in the ground.

While these systems may work satisfactory under certain circumstances there exists a need for a portable security system, which can be easily deployed to monitor the perimeter of the construction site, or an area around the machinery in a continuous monitoring line such as that an intruder crossing the monitoring line established around the perimeter of the protected site or object will cause activation of an alarm system.

SUMMARY OF THE INVENTION

It is, therefore, an object of the present invention to provide a portable security system that can be transported from site-to-site and installed in an easy and inexpensive manner.

It is another object of the invention to provide a portable security system, which provides a perimeter monitoring in a continuous line about a perimeter of the site.

It is a further object of the invention to provide a portable security system that can be mounted on a board or incorporated into a housing and that can be placed in an unsecured unoccupied location or in a piece of machinery in an unsecured unoccupied location.

These and other objects of the invention are achieved through a provision of an alarm system designed for positioning in a predetermined unoccupied unsecured location, such as construction site, camp site and the like. The system incorporates electronic/electric components positioned inside a portable container and a means for defining a continuous monitoring line about perimeter of the location. The system has a programmable microprocessor secured within the housing and a motion-sensing/detecting device operationally connected to the microprocessor. The motion-sensing/detecting device generates an alarm signal in response to movement or shock of the portable housing.

An alarm device is coupled to the microprocessor; the alarm device generates an audio and/or visual alarm signal in response to movement of the portable housing from the predetermined location. An alarm signal transmitter transmits the alarm signal generated by the motion-sensing/detecting device to a remote location, such as a monitoring station or owner's cell phone.

The means, operationally connected to the microprocessor, for defining a continuous monitoring line about the perimeter of the predetermined location comprises a plurality of wireless sensors positioned about the perimeter of the construction site, or a piece of valuable equipment, machinery and the like. The wireless sensors are supported on a flexible non-stretchable tape, which is suspended between vertical poles.

Each of the wireless sensors comprises a wireless transmitter member and a magnet member positioned at a predetermined distance, for instance less than one inch, from the wireless transmitter member. Any increase in distance between the wireless transmitter member and the magnet member generates an alarm processed by the microprocessor and transmitted to the alarm device and the alarm signal transmitter. A re-chargeable battery powers the system.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
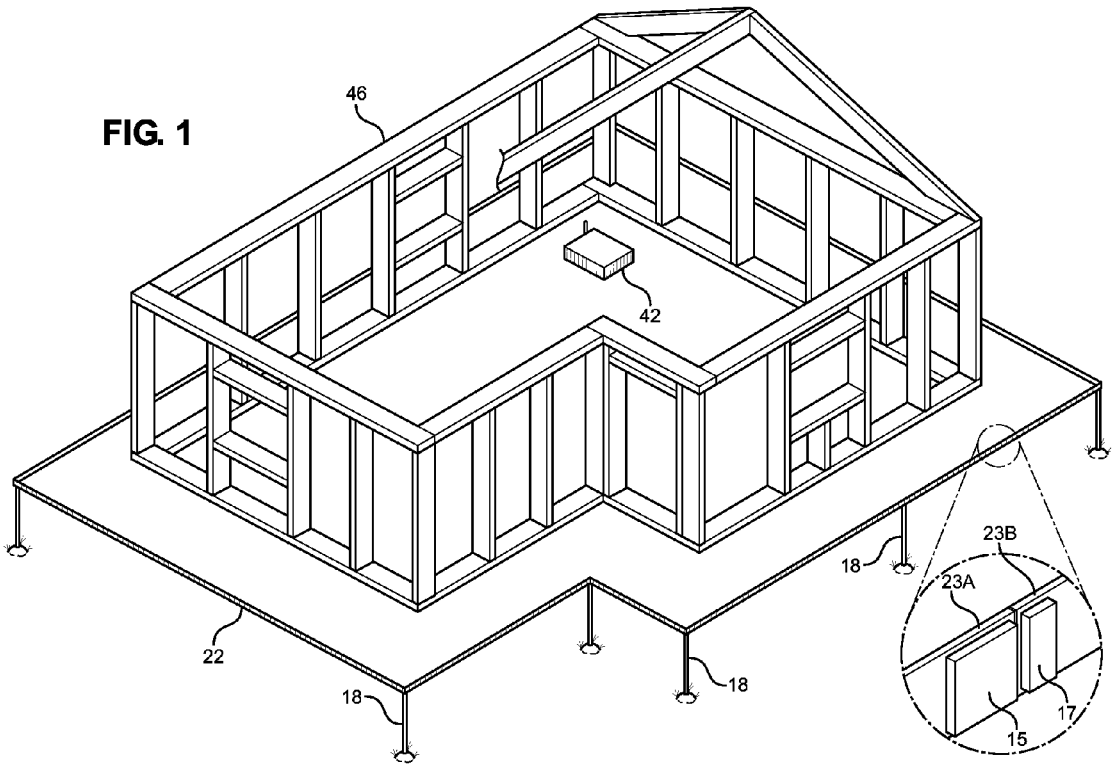
FIG. 1 is a schematic view illustrating position of the alarm system of the present invention at an unprotected unoccupied site.
Figure 2:
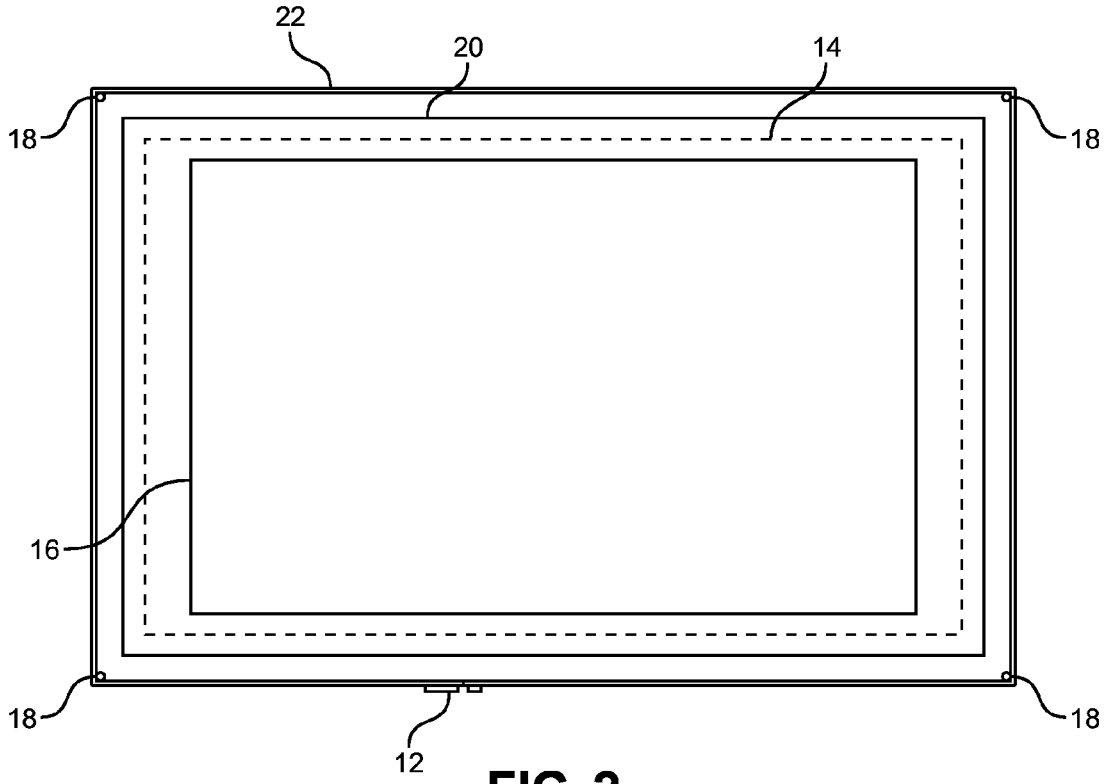
FIG. 2 is a schematic view of the continuous monitored site and the perimeter line defined for protection by the system of the present invention.

Turning now to the drawings in more detail, numeral 10 designates the security system according to the present invention. The system 10 comprises a plurality of wireless sensors 12, or other deviation sensing devices, installed about an imaginary perimeter line 14 of an unsecured unoccupied site 16. The site 16 can be a house under construction, a building being renovated, a campsite, or other location where valuable property is temporary stored.

Each of wireless sensors 12 comprises a sensor member mountable on a support means, such as vertical pole 18 or on suspended tape 22, in a non-conspicuous manner. It is envisioned that a plurality of poles can be erected about the perimeter of the protected area; the poles can be spaced at a desired predetermined distance from each other so that the tape formed a continuous monitoring line.

The sensor member 12 may have magnetic backing to allow easy positioning on metal poles 18. Alternatively, the sensor member 12 may have a double-sided tape fitted on the back surface to allow positioning of the sensor member 12 on a wooden or plastic pole 18. Still another alternative is to use screws for attaching the sensor 12 to a pole 18. The sensor member 12 can be positioned on adjacent ends of the tape using an adhesive or a mechanical securing means.

The sensor member 12 is compatible with wireless security systems for instance DSC wireless receivers. The sensor member 12 is capable of transmitting signals in 400 Mhz-900 Mhz range. The sensor members 12 are removably positioned on the poles 18 that are installed in a spaced-apart relationship about the perimeter line 14.

Each sensor member 12 comprises a transmitter member 15 and a magnet member 17. A long-life battery (not shown) is incorporated in the body of the transmitter member 15. When positioned on the pole 18, the transmitter member 15 and the magnet member 17 are aligned so that the magnetic field generated by the magnet member 17 is within the receiving range of the transmitter member 15.

Figure 3:
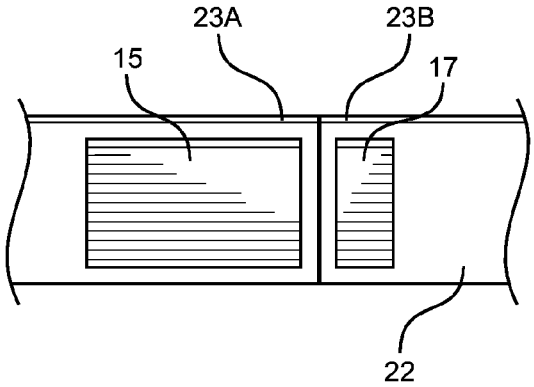
FIG. 3 is a detail view of the transmitter and magnet member secured to a tape.

In one aspect of the invention, the continuous monitoring line 20 is defined about the perimeter line 14 using a wire, a tape, a band, etc. In some embodiments of the invention the continuous monitoring line 20 is formed by a flexible non-stretchable tape 22, which spans between the poles 18 and is suspended thereon. The transmitter member 15 and the magnet member 17 can be positioned on adjacent ends 23*a*, 23*b* of the tape 22, as shown in FIG. 3.

Since the magnetic field generated by the magnet member 17 is relatively weak the magnet member 17 and the transmitter member 15 are designed to work when positioned within a pre-determined short distance from each other, for instance one inch or less. Any pulling force applied to the tape 22 will cause physical movement of the magnet member 17 to a distance greater than the pre-set distance (e.g. one inch).

Movement of the magnet 17 will interrupt the magnetic field created by the magnet member 17, which results in the transmitter member 15 to generate an alarm signal. The alarm signal is then transmitted to a wireless receiver/transducer 24. The wireless transducer 24 is equipped with a microprocessor 26 operationally connected to an alarm device 28. The alarm device 28 can be an audio siren, a strobe light, a loudspeaker and the like. The transducer device 24 is operationally connected to an alarm signal transmitter 30 either using hard-wiring method or a wireless connection.

In addition to the alarm signal on the construction site 16, a wireless alarm signal is sent to one or more remote locations. An alarm signal transmitter 30 is part of the system 10. The alarm signal transmitter 30 is equipped with an antenna 32, which sends an "intrusion" message to a remote monitoring station (not shown) and/or to a cell phone of a construction site or equipment owner. The remote monitoring station and/or owner can then call the law enforcement agency to dispatch police to the site 16.

Figure 4:
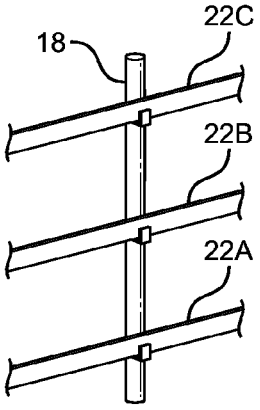
FIG. 4 is a detail alternative view of the tapes secured to a vertical pole.

In some aspects of the invention, a plurality of vertically spaced tapes 22*a*, 22*b*, and 22*c* can be secured to each of the poles 18, as shown in FIG. 4. In this manner, an intruder can be detected when the intruder touches any one of the tapes 22*a*, 22*b*, or 22*c*.

Figure 5:
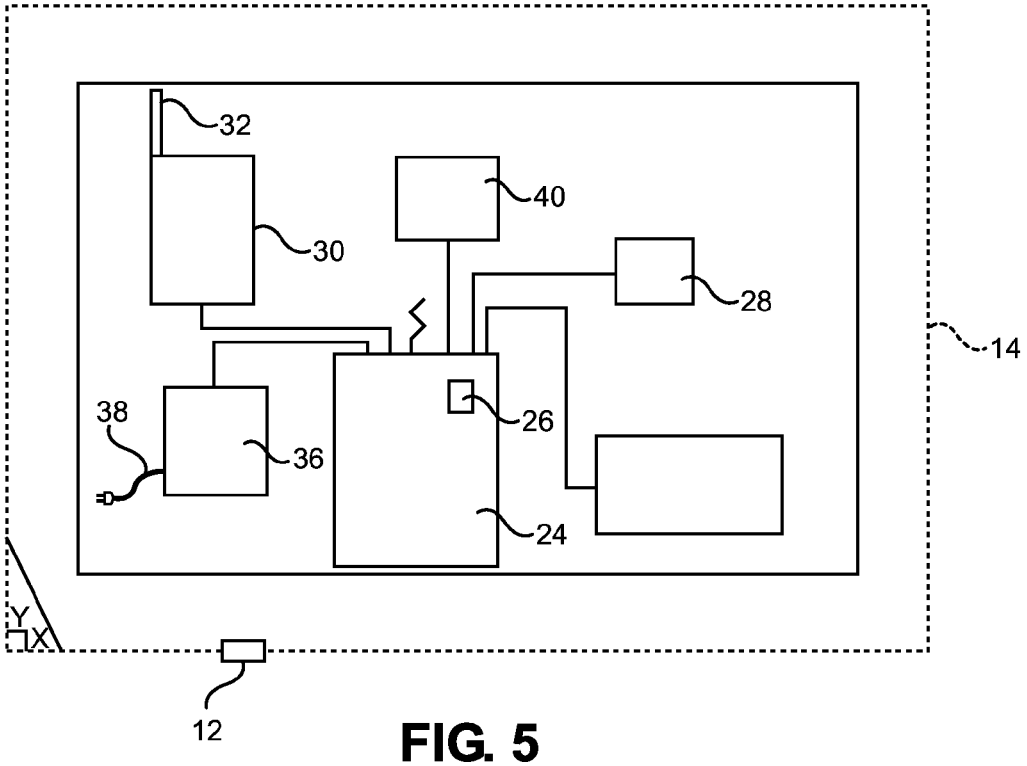
FIG. 5 is a schematic view of the electronic/electrical components of the alarm system of this invention according to the first embodiment.

As shown in FIG. 5, the system 10 further comprises a keypad 34, which is used to program the alarm system 10. The keypad 34 interacts with the alarm signal transmitter 24 and the microprocessor 26. A battery 36 can power the alarm system 10. The battery 36 can be periodically recharged using a AC/DC transformer connectable to a municipal power supply using a plug 38. The battery is designed to provide a power supply for powering all components of the security system 10 for 72 hours minimum before the transformer for charging the battery needs to be employed.

Should the intruder manage to breach the continuous monitoring line 20 and bypass the tape 22, the intruder may decide to remove the alarm system 10 before removing tools, equipment, wiring, or appliances from the unoccupied site. To detect tampering with the location of the system 10, a motion-sensing/detecting device 40 mounted in the housing. The motion-sensing/detecting device is connected to the microprocessor 26. The motion-sensing device 40 monitors the device movement such as tilt, shake, rotation, or swing.

All elements of the system 10, except for the sensors 12 can be mounted in one housing 42 to facilitate its transportation and storage. The housing 42 can be placed within the border defined by the continuous monitoring line 20 in any convenient location. In an exemplary embodiment shown in FIG. 1, the housing 42 is placed in an unfinished house 46, which may or may not have a roof and other structural components installed. If the intruder bypasses the continuous tape 22 installed about the continuous monitoring line 20 and attempts to move the housing 42, the same type of an alarm (siren, light) is generated by the system 10.

If desired, the housing 42 can be camouflaged as a briefcase or a tool chest in order to attract the intruder's attention and make it more likely that the intruder will move the housing 42, thereby generating the alarm.

Figure 6:
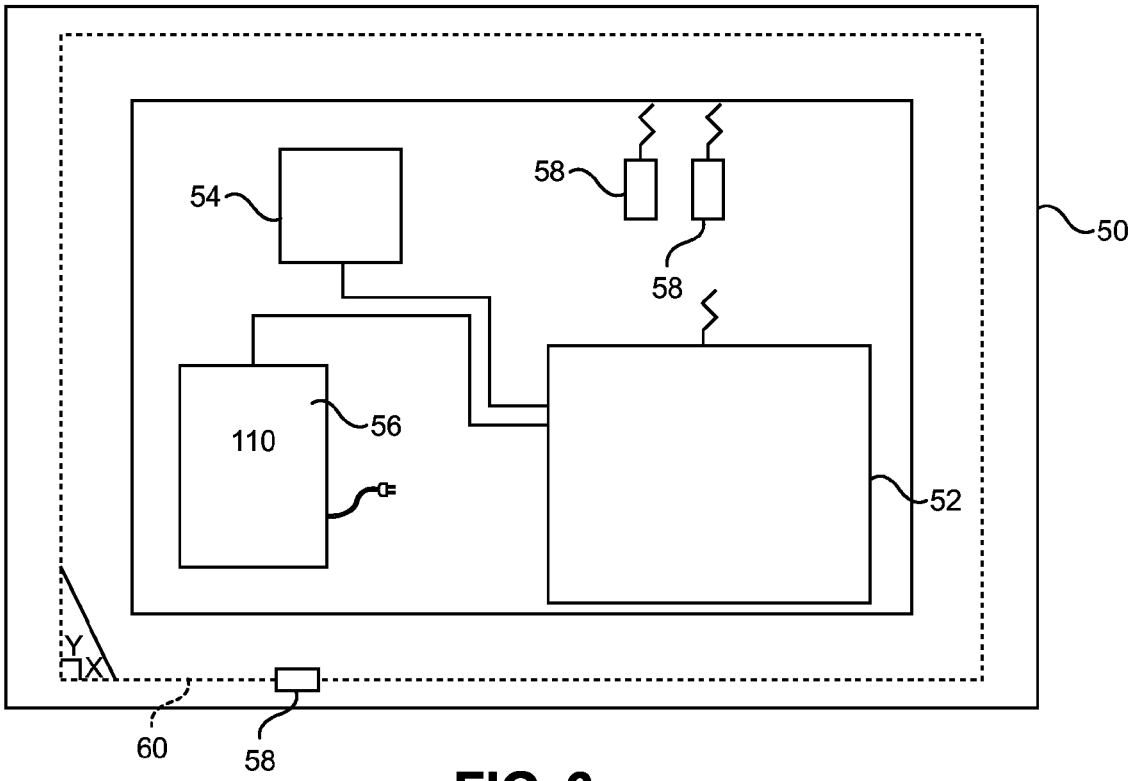
FIG. 6 is a schematic view of the electronic/electrical components of the alarm system of this invention according to the second embodiment.

FIG. 6 illustrates a second embodiment of the alarm system of the present invention. The alarm system 50 of the second embodiment, similarly to the first embodiment, comprises a control unit 52, which combines a wireless transducer with a programmable microprocessor, an audio/visual alarm device, an alarm system transmitter and a keypad. A motion-sensing/ detecting device 54 is operationally connected to the control unit 52. The motion-sensing/detecting device 54 is similar to the motion sensing/detecting device 40; it is designed to detect any movement of the system 50 from its predetermined location.

A rechargeable battery powers the system 50. The battery (not shown) is incorporated into the control unit 52. An AC/DC transformer 56 connected to the control unit 52; the transformer 56 is used to recharge the battery from a source of AC power. The system 50 may also include one or more sensor members 58, which are similar to the sensor members 12.

It is envisioned that the control unit 53, the transformer 56, and the motion-sensing/detecting device 54 can be positioned in a single compact housing, and the optional wireless sensor members 58 could be secured to a perimeter tape 60. The compact design of the system 50 allows it to be concealed in a piece of machinery left at the construction site. Should a wrongdoer decide to move the piece of equipment where an armed system 50 is placed, the vibration/shock imparted on the motion-sensing/detecting device 54 will cause actuation of the alarm system 50. The generated alarm signal will be sent to the remote monitoring station for transmittal to the police and/or to the owner of the machinery.

The housing for the system 50 can be placed behind an operator seat in a tractor, bobcat, or other place where detection thereof is unlikely. Alternatively, it can be placed in a location, where is it bound to attract the attention of a thief. The optional wireless sensor members 58 can be similarly placed on a tape (not shown) and the tape wrapped about a stable element of the machinery, for instance a driver seat.

A briefcase, a purse or other container that is likely to be moved by an intruder, can form the housing for the system 50. Once the intruder moves the housing, the movement sensing/detecting device 54 becomes activated, the alarm system will sound, and a remotely positioned monitoring service or the owner of the machinery can call for police assistance.

If desired, the alarm system of the present invention can be modified to use a laser beam, an infrared beam or other suitable means in lieu of the tape 22. The systems 10 and 50 can be also modified to include an instant camera positioned in the housing to take a photograph of the intruder/thief and thereby assist law enforcement personnel in identifying the criminal. In the preferred embodiment, the housing is waterproof and tamper-proof allowing deployment of the housing in an open area regardless of the weather conditions.

Many other changes and modifications can be made in the present invention without departing from the spirit thereof. I, therefore pray that my rights to the present invention be limited only by the scope of the appended claims.

I claim:

1. An alarm system, comprising:

a portable housing positionable in a predetermined location;

a programmable microprocessor secured within said housing;

at least one motion-sensing/detecting device operationally connected to the microprocessor, said at least one motion-sensing/detecting device generating an alarm signal in response to movement of the portable housing from the predetermined location;

an alarm device coupled to the microprocessor, the alarm device generating an audio and/or visual alarm signal in response to movement of the portable housing from the predetermined location;

a flexible tape means for defining a continuous monitoring line about a perimeter of the predetermined location, said flexible tape means comprising separate sections of flexible non-stretchable tape suspended between spaced apart vertical poles; and at least one alarm signal transmitter operationally connected to the microprocessor and transmitting the alarm signal generated by the at least one motion-sensor detecting device to a remote location, the at least one alarm signal transmitter and the at least one motion-sensing/detecting device being suspended in close proximity on the flexible tape.

2. The system of claim 1, said at least one alarm signal transmitter is capable of wireless transmission.

3. The system of claim 1, the at least one motion-sensing/detecting device comprising at least one wireless sensor.

4. The system of claim 3, wherein the vertical poles are positioned about the perimeter of the predetermined location.

5. The system of claim 4, wherein the at least one motion-sensing/detecting device comprises a magnet member such that an increase in distance between the at least one wireless transmitter member and the magnet member generates an alarm processed by the microprocessor and transmitted to the alarm signal transmitter.

6. The device of claim 5, said at least one wireless transmitter member and the magnet member are supportable by adjacent vertical poles.

7. The system of claim 1, comprising a plurality of vertically spaced tapes extending between the vertical poles.

8. The system of claim 6, wherein the at least one wireless transmitter member and the magnet member are each secured to adjacent free ends of the tape sections.

9. The system of claim 1, said predetermined location is an unoccupied unsecured location.

10. The system of claim 1, comprising a rechargeable battery.

11. The system of claim 10, comprising a transformer for connecting the battery to a source of AC power.

12. The system of claim 1, comprising a keypad for activating the alarm system, the keypad being positioned in the housing and operationally connected to the microprocessor.

13. An alarm system for a predetermined unoccupied unsecured location, comprising:

a portable housing positionable in the predetermined location;

a programmable microprocessor secured within said housing;

a motion-sensing/detecting device operationally connected to the microprocessor, said motion-sensing/detecting device generating an alarm signal in response to movement of the portable housing from the predetermined location;

an alarm device coupled to the microprocessor, the alarm device generating an audio and/or visual alarm signal in response to movement of the portable housing from the predetermined location;

an alarm signal transmitter transmitting the alarm signal generated by the motion-sensing/detecting device to a remote location;

a means, operationally connected to the microprocessor, for defining a continuous monitoring line about a perimeter of the predetermined location, said means for defining the continuous monitoring line comprising a plurality of wireless sensors positioned about the perimeter of the predetermined location; and a plurality of vertical poles spaced about the perimeter of the predetermined location and at least one flexible non-stretchable tape composed of distinct tape segments suspended between the poles, and wherein the wireless sensors are suspended on adjacent free ends of the tape segments.

14. The system of claim 13, wherein each of the wireless sensors comprises a wireless transmitter member and a magnet member positioned on adjacent free ends of the tape segments at a predetermined distance from each other such that an increase in distance between the wireless transmitter member and the magnet member generates an alarm processed by the microprocessor and transmitted to the alarm device and a remote location.

15. The system of claim 13, comprising a plurality of vertically spaced tapes suspended between the poles.

16. The system of claim 13, comprising a rechargeable battery.

17. The system of claim 16, comprising a transformer for connecting the battery to a source of AC power.

18. The system of claim 13, comprising a keypad for activating the alarm system, the keypad being positioned in the housing and operationally connected to the microprocessor.

* * * * *